US008113166B2

(12) United States Patent
Kumagai et al.

(10) Patent No.: US 8,113,166 B2
(45) Date of Patent: Feb. 14, 2012

(54) AUTO CHOKE DEVICE FOR AN ENGINE

(75) Inventors: Toshimichi Kumagai, Kyoto-fu (JP); Masanobu Yamamoto, Shizuoka-ken (JP); Shinichi Kajiya, Shizuoka-ken (JP)

(73) Assignees: Kyoto Denkiki Co., Ltd., Kyoto (JP); Yamaha Motor Power Products Kabushiki Kaisha, Shizuoka (JP)

( * ) Notice: Subject to any disclaimer, the term of this patent is extended or adjusted under 35 U.S.C. 154(b) by 726 days.

(21) Appl. No.: 11/775,811

(22) Filed: Jul. 10, 2007

(65) Prior Publication Data

US 2008/0245339 A1 Oct. 9, 2008

(30) Foreign Application Priority Data

Apr. 4, 2007 (JP) ..... 2007-098538

(51) Int. Cl.

| | |
|---|---|
| ***F02D 41/06*** | (2006.01) |
| ***F02D 11/10*** | (2006.01) |
| ***F02M 1/00*** | (2006.01) |
| ***F02M 1/02*** | (2006.01) |

(52) U.S. Cl. ..... 123/179.18; 123/399; 261/64.6

(58) Field of Classification Search ..... 123/179.18, 123/179.16, 339.1, 403, 437, 438; 701/113; 261/64.6, 39.1, 39.2, 39.3

See application file for complete search history.

(56) References Cited

U.S. PATENT DOCUMENTS

| | | | | |
|---|---|---|---|---|
| 1,764,659 | A * | 6/1930 | Charles | 123/179.15 |
| 2,226,580 | A * | 12/1940 | Perrine | 261/39.2 |
| 2,793,634 | A * | 5/1957 | Ericson | 123/179.3 |
| 2,799,455 | A * | 7/1957 | Osann, Jr. | 236/101 R |
| 4,027,640 | A * | 6/1977 | Hirosawa et al. | 261/39.6 |
| 4,068,636 | A * | 1/1978 | Nau et al. | 123/572 |
| 4,192,834 | A * | 3/1980 | Berkbigler | 261/52 |
| 4,463,723 | A * | 8/1984 | Tansuwan | 123/438 |
| 4,662,333 | A * | 5/1987 | Martel | 123/339.13 |
| 4,730,589 | A * | 3/1988 | Ohtaki et al. | 123/438 |
| 4,987,871 | A * | 1/1991 | Nishikawa | 123/362 |
| 5,031,593 | A * | 7/1991 | Erhard et al. | 123/331 |
| 5,048,486 | A * | 9/1991 | Okuda et al. | 123/406.66 |
| 5,660,765 | A * | 8/1997 | King et al. | 261/39.3 |
| 6,145,487 | A * | 11/2000 | Dykstra et al. | 123/179.18 |
| 6,722,638 | B2 * | 4/2004 | Kojima et al. | 261/39.2 |
| 6,851,664 | B2 * | 2/2005 | Gangler et al. | 261/64.3 |
| 7,097,163 | B2 * | 8/2006 | Moriyama et al. | 261/52 |

(Continued)

FOREIGN PATENT DOCUMENTS

| | | |
|---|---|---|
| JP | 50-135440 A | 10/1975 |
| JP | 58-155256 A | 9/1983 |
| JP | 60-222547 | 11/1985 |

OTHER PUBLICATIONS

U.S. Appl. No. 11/775,830, filed Jul. 10, 2007, Kumagai, et al.

(Continued)

*Primary Examiner* — Stephen K Cronin
*Assistant Examiner* — Sizo Vilakazi
(74) *Attorney, Agent, or Firm* — Keating & Bennett, LLP

(57) ABSTRACT

An auto choke device for an engine includes a choke valve for varying the opening of an intake passage of the engine, and a starter motor for starting the engine. Upon activation of the starter motor, the choke valve starts valve opening motion from a fully closed position. The choke valve continues the valve opening motion at a certain valve opening speed until it achieves a start opening set based on the temperature of the engine.

8 Claims, 5 Drawing Sheets

U.S. PATENT DOCUMENTS

| | | | | |
|---|---|---|---|---|
| 7,171,947 | B2 * | 2/2007 | Fukushima et al. | 123/399 |
| 7,246,591 | B2 * | 7/2007 | Shinogi et al. | 123/179.18 |
| 7,377,496 | B2 * | 5/2008 | Toda et al. | 261/43 |
| 7,611,131 | B2 * | 11/2009 | Engman et al. | 261/64.1 |
| 2003/0164558 | A1 * | 9/2003 | Kojima et al. | 261/64.6 |
| 2005/0200030 | A1 * | 9/2005 | Kamimura et al. | 261/39.1 |
| 2006/0266330 | A1 * | 11/2006 | Fukushima et al. | 123/399 |
| 2008/0245331 | A1 * | 10/2008 | Kumagai et al. | 123/179.16 |

OTHER PUBLICATIONS

Official Communication issued in corresponding Chinese Patent Application No. 200710136350, mailed on Dec. 11, 2009.

English translation of Official Communication issued in corresponding Japanese Patent Application No. 2007-098538, mailed on Feb. 22, 2011.

* cited by examiner

[FIG. 1]
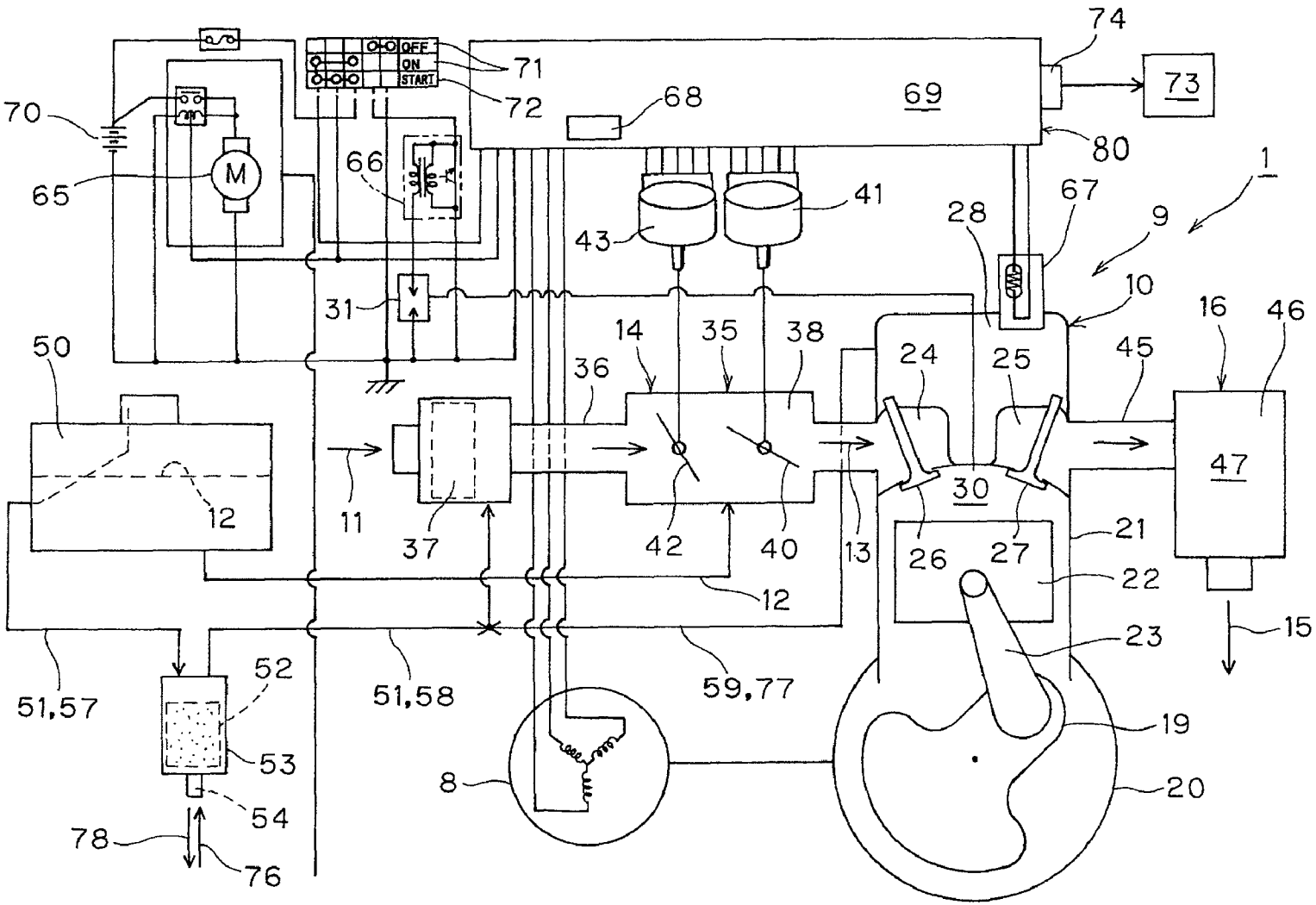

[FIG. 2]
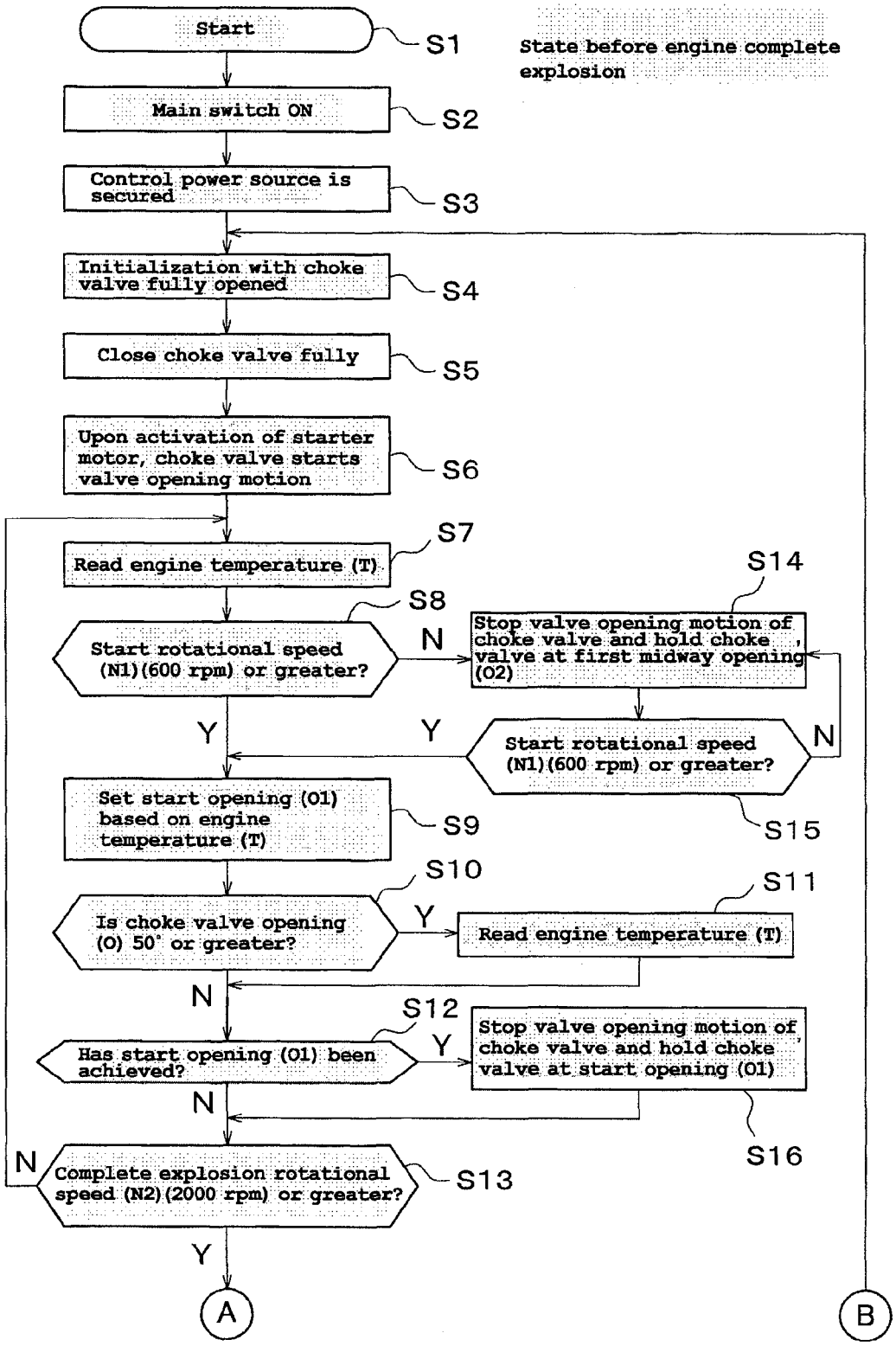

[FIG. 3]
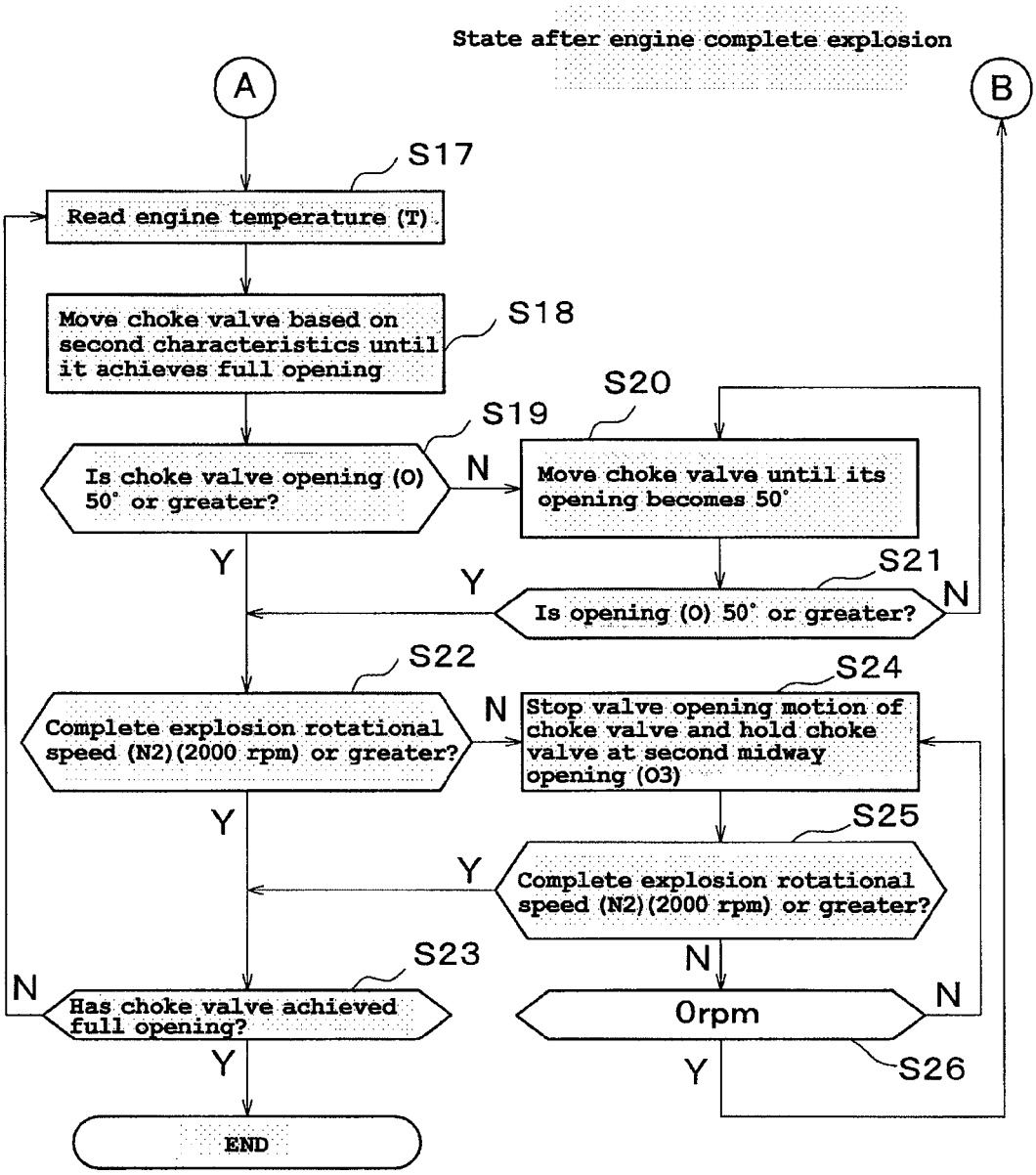

[FIG. 4]
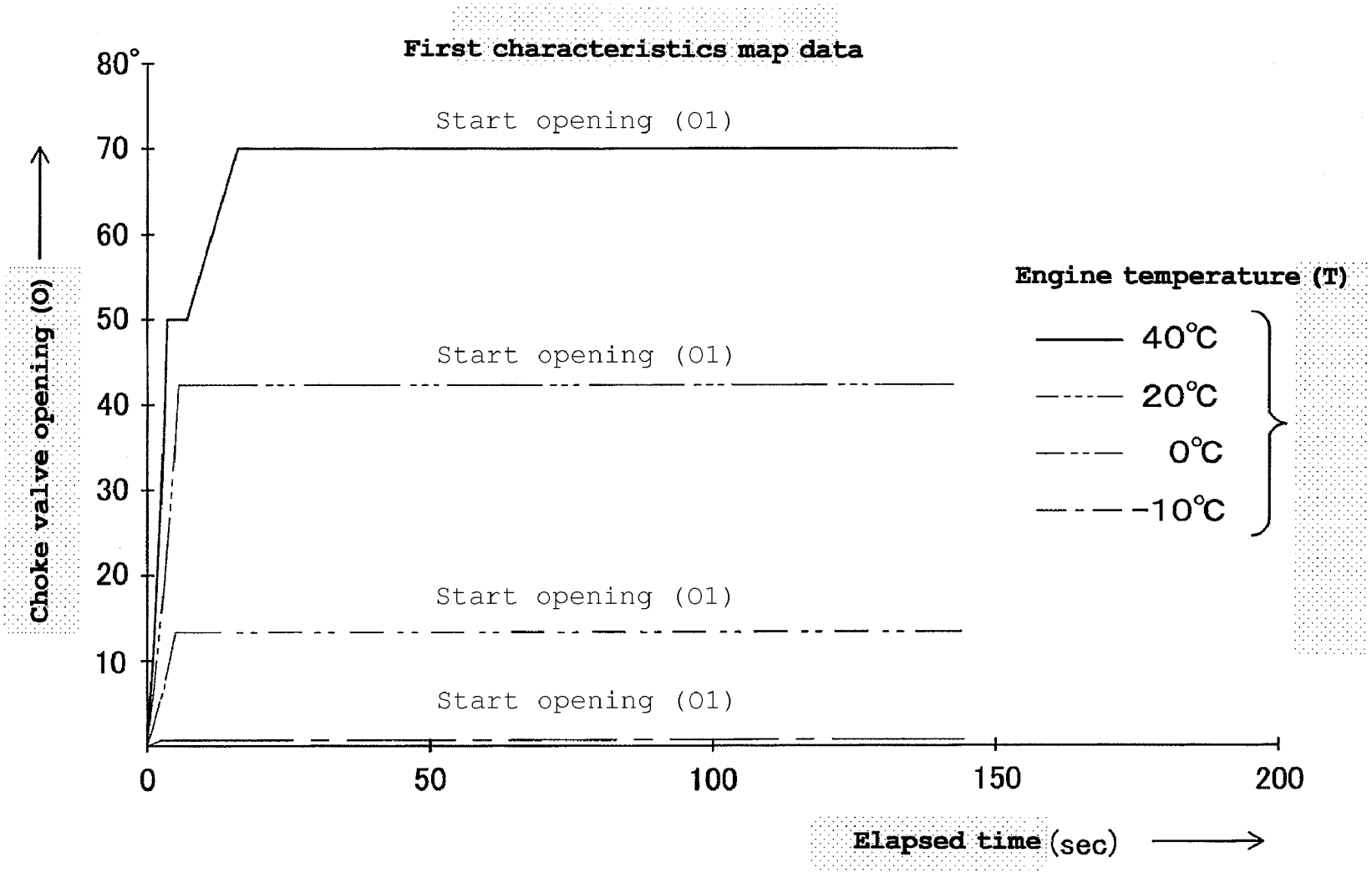

[FIG. 5]
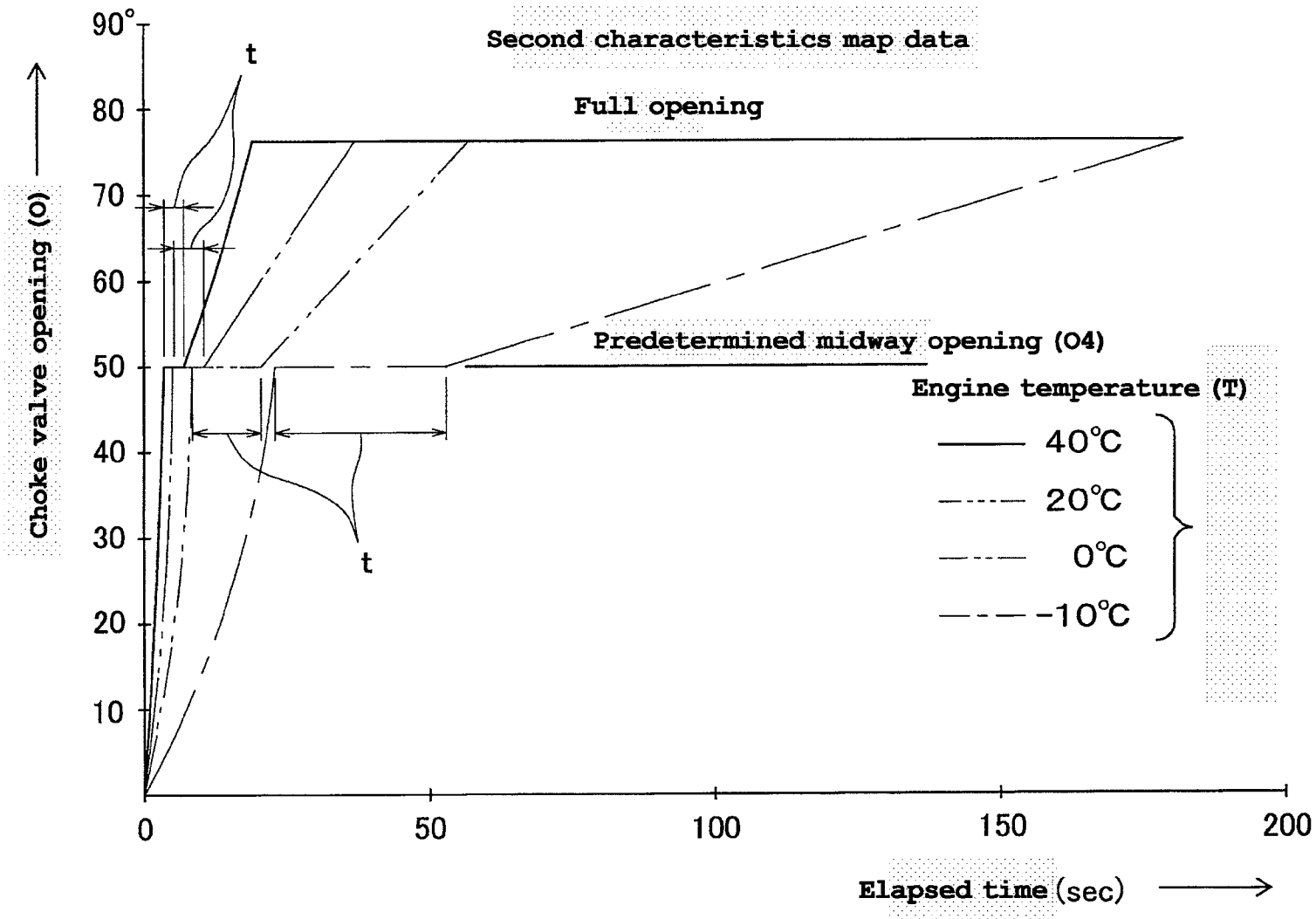

AUTO CHOKE DEVICE FOR AN ENGINE

CROSS-REFERENCE TO RELATED APPLICATIONS

The present application is based on and claims priority under 35 U.S.C. § 119 to Japanese Patent Application No. 2007-098538, filed on Apr. 4, 2007, the entire contents of which are expressly incorporated by reference herein.

BACKGROUND OF THE INVENTION

1. Field of the Invention

The present invention relates to a choke device for an engine, and more particularly to an auto choke device for an engine which controls the valve opening motion of a choke valve based on the temperature of the engine, when a starter motor is activated.

2. Description of the Related Art

One conventional auto choke device for an engine is disclosed in Japanese Publication No. JP 60-222547. The auto choke device disclosed in JP 60-222547 includes a choke valve for varying the opening of an intake passage of the engine, and a starter motor for starting the engine. During the start of the engine, the valve opening motion of the choke valve is controlled based on the temperature of the engine, and the like. The proper start of the engine is thereby assured.

The start of the engine depends on various starting conditions, such as the environment conditions surrounding the engine based on the temperature, humidity and atmospheric pressure, the quality of fuel, and the degree of deterioration of the fuel with age. For this reason, when the valve opening motion of the choke valve during engine start is set based on limited conditions such as the temperature of the engine, the proper opening of the choke valve may not be obtained during the start. This may cause improper start of the engine (e.g., the engine becomes more likely to stall).

SUMMARY OF THE INVENTION

In view of the circumstances noted above, an aspect of at least one of the embodiments disclosed herein is to provide an auto choke device for an engine which can more reliably provide proper engine start even when various start conditions are involved during the start of the engine.

In accordance with one aspect of the invention, an auto choke device for an engine is provided. The auto choke device comprises a starter motor configured to start the engine, and a choke valve configured to vary the opening of an intake passage of the engine. The choke valve is configured to begin opening from a fully closed position upon activation of the starter motor and to continue to open at a desired valve opening speed until the choke valve achieves a predetermined start opening position based at least on the temperature of the engine.

In accordance with another aspect of the invention, a method for operating an auto choke device for an engine is provided. The method comprises beginning a choke valve opening motion upon activation of a starter motor of the engine, sensing a temperature of the engine, sensing a speed of the engine, determining whether the engine speed has reached a desired start rotational speed, setting a choke valve start opening position based on the sensed engine temperature if the engine speed is equal to or greater than the desired start rotational speed, and moving the choke valve toward the start opening position.

BRIEF DESCRIPTION OF THE DRAWINGS

These and other features, aspects and advantages of the present inventions will now be described in connection with preferred embodiments, in reference to the accompanying drawings. The illustrated embodiments, however, are merely examples and are not intended to limit the inventions. The drawings include the following 19 figures.

FIG. 1 is a schematic diagram generally illustrating a generating apparatus.

FIG. 2 illustrates a part of a flowchart of the control process for a controller of the generating apparatus shown in FIG. 1, in accordance with one embodiment.

FIG. 3 illustrates the other part of the flowchart of the control process for the controller of the generating apparatus shown in FIG. 1.

FIG. 4 illustrates one example of a first characteristics map.

FIG. 5 illustrates a second characteristics map.

DETAILED DESCRIPTION OF THE PREFERRED EMBODIMENT

FIG. 1 illustrates one embodiment of a generating apparatus 1. In a preferred embodiment, the generating apparatus 1 is portable. The generating apparatus 1 can have a trolley (not shown) that can be placed on a work surface, such as the ground or the floor, and be movable on the work surface. On the trolley, a four-stroke engine 9 can be supported for driving a three-phase AC generator 8. The engine 9 includes an engine body 10, an intake member 14 and an exhaust member 16. The engine body 10 outputs a driving force therefrom. The intake member 14 supplies a mixture 13 of air 11 and fuel 12 to the engine body 10. The exhaust member 16 discharges burnt gas of the mixture 13 burnt in the engine body 10 to the outside as exhaust 15.

With continued reference to FIG. 1, the engine body 10 includes a crankcase 20, a cylinder 21, a piston 22, a connecting rod 23, intake and exhaust valves 26, 27 and a valve mechanism (not shown) for operating the intake and exhaust valves 26, 27. The crankcase 20 supports a crankshaft 19 therein. In the illustrated embodiment, the cylinder 21 protrudes from the crankcase 20. The piston 22 is fitted in the cylinder 21 in such a manner that it can slide axially therealong. The connecting rod 23 operatively connects the crankshaft 19 and the piston 22. The intake and exhaust valves 26, 27 selectively open and close intake and exhaust passages 24, 25, respectively, formed at a protruded end of the cylinder 21. The valve mechanism selectively opens and closes the intake and exhaust valves 26, 27 enclosed in a valve chamber 28 which is formed at the protruded end of the cylinder 21. A spark plug 31 has an electrical discharge part facing a combustion chamber 30 in the cylinder 21.

The intake member 14 can include a carburetor 35, an intake pipe 36 and an air cleaner 37, which can be connected to the intake passage 24 in series to communicate therewith. In the illustrated embodiment, the carburetor 35, the intake pipe 36 and the air cleaner 37 define another intake passage 38 therein communicating with the intake passage 24. The carburetor 35 includes a throttle valve 40, an actuator 41, a choke valve 42 and an actuator 43. The throttle valve 40 can vary the opening of the intake passage 38. The actuator 41 can be a step motor and actuates the throttle valve 40. The choke valve 42 can vary the opening of the intake passage 38 at a position upstream of the throttle valve 40. The actuator 43 can be a step motor and actuates the choke valve 42.

The exhaust member 16 includes an exhaust pipe 45 and a muffler 46 which can be connected to the exhaust passage 25 in series to communicate therewith. The exhaust pipe 45 and the muffler 46 can define another exhaust passage 47 therein communicating with the exhaust passage 25.

A fuel tank 50 can be disposed above the engine 9. The fuel tank 50 stores therein fuel 12 to be supplied to the engine 9 via the carburetor 35. In the illustrated embodiment, an absorbent 52 and a canister 53 are provided. The absorbent 52 can absorb evaporated fuel 51 generated from the fuel 12 in the fuel tank 50. The canister 53 encloses the absorbent 52 therein. The absorbent 52 can be activated carbon. Through the bottom of the canister 53, a communication hole 54 is disposed which communicates the canister 53 and the ambient atmosphere.

A communication passage 57 is provided for communicating the upper end of the fuel tank 50 and the upper end of the canister 53. Another communication passage 58 is also provided for communicating the upper end of the canister 53 and the air cleaner 37 of the intake member 14. A blow-by gas passage 59 is provided for communicating the valve chamber 28 and the air cleaner 37 of the intake member 14. The passages 57 to 59 can each be formed of a flexible rubber tube.

With continued reference to FIG. 1, a starter motor 65, an ignition device 66, a temperature sensor 67 and a rotational speed sensor 68 are provided. The starter motor 65 starts the engine 9. The ignition device 66 causes the spark plug 31 to selectively discharge electricity. The temperature sensor 67 detects the temperature of the engine body 10 of the engine 9. The rotational speed sensor 68 detects the rotational speed of the crankshaft 9 of the engine body 10. Specifically, the temperature sensor 67 can detect the temperature of the atmosphere in a head cover of the engine body 10. The rotational speed sensor 68 can be installed in a controller 69 and monitors the period of time for which the voltage waveform of the electricity outputted from the generator 8 is repeated to thereby detect the speed (N) of the engine 9.

A controller 69, a battery 70, a main switch 71 and a starter switch 72 are provided. The controller 69 can receive detection signals from at least the temperature sensor 67 and the rotational speed sensor 68 to electronically control the actuators 41, 43 and the ignition device 66. The battery 70 can receive a part of the electricity generated by the generator 8, via the controller 69, to store it therein and to supply the electricity to the actuators 41, 43, the ignition device 66 and the like via the controller 69. The main switch 71 selectively enables the supply of electricity from the battery 70 to at least the starter motor 65, the controller 69 and the like. The starter switch 72 selectively enables the supply of electricity from the battery 70 to the starter motor 65 via the main switch 71. The controller 69 is provided with an output unit 74 for outputting the other part of the electricity generated by the generator 8 to an external load 73.

The main switch 71 and the starter switch 72 can be formed together as a key switch. As the user turns the key by a certain angle from an "off" position, the main switch 71 will be first turned ON. As the user turns the key further by a certain angle, the starter switch 72 will be turned ON, and thus the starter motor 65 will be activated. As the user releases the key, the starter switch 72 will be turned OFF automatically, and thus the starter motor 65 will be deactivated automatically. At this time, the main switch 71 will be held ON.

When the engine 9 is driven through the control by the controller, outside air 11 will be sucked through the intake member 14 into the engine 9. Fuel 12 will be supplied to the intake air 11 by the carburetor 35 into a mixture 13, which will be burnt in the engine 9. At a result, the engine 9 drives the generator 8, which outputs electricity. The electricity generated by the generator can be outputted at least to the load 73 via the output unit 74 of the controller 69. The burnt gas resulting from combustion in the engine 9 will be discharged to the outside through the exhaust member 16 as exhaust 15.

Referring to FIGS. 1 to 5, an auto choke device 80 is provided. The auto choke device 80 controls the valve opening motion of the choke valve 42 for proper start of the engine 9, when the engine 9 is started by the user activating the starter motor 65 in order to operate the generating apparatus 1. The auto choke device 80 can be controlled by the controller 69. Description will now be made of the auto choke device 80.

FIGS. 2 and 3 are flowcharts of the control process of the valve opening motion of the choke valve 42 for the controller 69 of the auto choke device 80. In these figures, symbol S denotes each step of the program. Symbols A and B in FIG. 2 are meant to be respectively connected to symbols A and B in FIG. 3.

The controller 69 includes a memory having stored therein a first characteristics data map (FIG. 4) and a second characteristics data map (FIG. 5), which are based on the temperatures (T) of the engine 9 and different from each other. The memory can include a ROM(s) to store control programs executed by the controller 69, as well as various control data, and a RAM(s), flash memory, an EEPROM(s) or other suitable storage device to temporarily store data.

Referring to FIG. 2, to start the engine 9 (S1), the main switch 71 is first turned ON by the user turning the key switch (S2). Electricity is thereby supplied from the battery 70 to the controller 69, so that a control power source is secured (S3). Then, the actuator 43 is activated and actuated in a forward direction in a manner causing the choke valve 42 to achieve the maximum opening (O). With the choke valve 42 fully opened, a counter of the actuator 43 is initialized (S4). Next, the actuator 43 is actuated in a reverse direction in a manner causing the choke valve 42 to achieve the fully closed state opening (O) (S5).

At this time, as the user turns the key switch further, the starter switch 72 is turned ON, and thus the starter motor 65 is activated (S6). As a result, the cranking of the engine 9 begins, and the choke valve 42 starts the valve opening motion from the fully closed position (S6). At this time, the choke valve 42 is controlled based on the first characteristics data map described above. Based on a detection signal from the temperature sensor 67, the temperature (T) of the engine 9 is first read into the controller (S7).

If determination based on a detection signal from the rotational speed sensor 68 is that the speed (N) of the engine 9 has become a certain start rotational speed (N1) (e.g., 600 rpm) or greater (S8), the start opening (O1) of the choke valve 42 is set based on the temperature (T) of the engine 9 read in the above S7 (S9). The start opening (O1) can be set to be proportional to the temperature (T) of the engine 9 (e.g., 0° for −10° C.; 70° for 40° C.). The choke valve 42 continues the valve opening motion at a certain valve opening speed (V) until it achieves the above start opening (O1).

In S10, if determination is that the opening (O) of the choke valve 42 is 50° or greater, the temperature (T) of the engine 9 is read (S11).

In S12, if determination is that the choke valve 42 has not achieved the start opening (O1), then it is determined whether or not the speed (N) of the engine 9 is a certain complete explosion rotational speed (N2) (e.g., 2000 rpm) or greater (S13). The complete explosion rotational speed (N2) is defined, but not strictly defined, as a minimum rotational speed (N) at which the engine 9 is able to continue operation almost on its own without the help of the starter motor 65.

In the above S13, if the determination is that the speed (N) of the engine 9 is not greater than the complete explosion rotational speed (N2), the engine 9 is determined to be in the "state before engine complete explosion" and the process returns to the above step S7. Next, in the above S8, if the determination is that the speed (N) of the engine 9 has become a value not greater than the start rotational speed (N1), the valve opening motion of the choke valve 42 is stopped temporarily and the choke valve 42 is held at a first midway opening (O2) at that time point (S14).

The choke valve 42 continues to be held at the first midway opening (O2) until the speed (N) of the engine 9 becomes the start rotational speed (N1) or greater (S15). If the determination is that the rotational speed (N) has become the start rotational speed (N 1) or greater (S15), the process returns to the above S9 and the choke valve 42 is moved again from the first midway opening (O2) toward the start opening (O1). If the choke valve 42 has achieved the start opening (O1) (S12), the valve opening motion of the choke valve 42 is stopped and the choke valve 42 is held at the start opening (O1) (S16).

The first characteristics data map (FIG. 4) is used when the engine is in the "state before engine complete explosion" (FIG. 2) described above, where the speed (N) of the engine 9 is not greater than the complete explosion rotational speed (N2). The first characteristics data map (FIG. 4) is preferably designed such that the valve opening speed (V) (opening/time) of the choke valve 42 described above becomes higher for the higher temperature (T) of the engine 9 (specifically within the range of approximately 0 to 10 sec. of the elapsed time in FIG. 4).

Referring to FIG. 2, in the above S13, if the determination is that the speed (N) of the engine 9 is the complete explosion rotational speed (N2) or greater, the engine 9 is determined to be in the "state after engine complete explosion" and the temperature (T) of the engine 9 is newly read as shown in FIG. 3 (S17). In this case, the choke valve 42 is controlled using the second characteristics data map (FIG. 5) in place of the first characteristics data map (S18).

Next in S19, if determination is that the opening (O) of the choke valve 42 is not 50° or greater, the choke valve 42 is moved by the actuator 43 until the opening (O) of the choke valve 42 becomes 50° in S20. If the opening (O) of the choke valve 42 has become 50° (S21), S22 is executed.

In the above S22, if determination is that the speed (N) of the engine 9 is the complete explosion rotational speed (N2) or greater, the valve opening motion of the choke valve 42 is continued. If the opening (O) of the choke valve 42 has not become the full opening (S23), the process returns to S17. On the other hand, if the choke valve 42 has achieved the full opening (S23), the start of the engine 9 via control of the auto choke valve 42 by the controller 69 of the auto choke device 80 ends. The engine 9 is then brought to a normal operating state.

In the above S22, if the speed (N) of the engine 9 has become a value not greater than the complete explosion rotational speed (N2), the choke valve 42 is held at a second midway opening (O3) at that time point (S24). The choke valve 42 continues to be held at the second midway opening (O3) until the speed (N) of the engine 9 becomes the complete explosion rotational speed (N2) or greater. If determination is that the rotational speed (N) has become the complete explosion rotational speed (N2) or greater (S25), the process returns to the above S23 and the choke valve 42 is moved again from the second midway opening (O3) toward the full opening.

On the other hand, if the determination in the above S25 is that the speed (N) of the engine 9 is not greater than the complete combustion rotational speed (N2) and determination in S26 is that the engine speed is not 0 rpm, the process returns to S24. If the determination in the above S26 is that the engine speed is 0 rpm, then the engine 9 is determined to be stopped and the process returns to the above S4. The engine 9 thus becomes ready to restart.

The second characteristics data map (FIG. 5) is used when the engine is in the "state after engine complete explosion" (FIG. 3), where the speed (N) of the engine 9 is the complete explosion rotational speed (N2) or greater. The second characteristics data map (FIG. 5) is designed such that when the opening (O) of the choke valve 42 has become a predetermined midway opening (O4), the choke valve is held at the predetermined midway opening (O4) for a predetermined time (t). Further, the second characteristics data map is designed such that after the lapse of the predetermined time (t), the choke valve 42 is moved at a certain valve opening speed (V) (opening/time) until it achieves the full opening. Furthermore, the second characteristics data map is designed such that the predetermined time (t) becomes shorter for the higher temperature (T) of the engine 9.

Further, the second characteristics data map is designed such that the valve opening speed (V) during the first valve opening motion of the choke valve 42 to be continued until it achieves the predetermined midway opening (O4) and the valve opening speed (V) during the second valve opening motion of the choke valve 42 to be continued until it achieves the full opening from the predetermined midway opening (O4) become higher for the higher temperature (T) of the engine 9. It is understood that the second characteristics data map can be designed such that only the valve opening speed (V) during the second valve opening motion of the first and second valve opening motions becomes higher for the higher temperature (T) of the engine 9 as described above.

With the above configuration, upon the activation of the starter motor 65, the choke valve 42 starts the valve opening motion from the fully closed position (S6). The choke valve 42 continues the valve opening motion at the certain valve opening speed (V) until it achieves the start opening (O1) set based on the temperature (T) of the engine (S12).

Thus, the choke valve 42 is in a fully closed state when the engine 9 is started through the activation of the starter motor 65. The choke valve continues the valve opening motion from the fully closed position until it achieves the start opening (O1). In this case, when the start opening (O1) is preset to be somewhat larger, it is ensured that the choke valve 42 passes through the optimal opening area at the above certain valve opening speed (V) in the middle of the valve opening motion. Accordingly, when the choke valve passes through the above area, a start condition proper for the start of the engine 9 is reliably obtained. As a result, the proper start of the engine 9 is provided more reliably.

As described above, after the speed (N) of the engine 9 had become the certain start rotational speed (N1) or greater (S8), when the speed (N) of the engine 9 has become a value not greater than the start rotational speed (N1) (S8) while the choke valve 42 is moving toward the start opening (O1), the choke valve 42 is held at the first midway opening (O2) at that time point (S14). Thereafter, when the speed (N) of the engine 9 has become the start rotational speed (N1) or greater (S15), the choke valve 42 is moved from the first midway opening (O2) to the start opening (O1).

As a result, during the start of the engine 9, when the engine is stopped temporarily for some reason and then restarted, the choke valve 42 is moved from the first midway opening (O2) toward the start opening (O1). Accordingly, compared to the case where the choke valve 42 is brought to a fully closed state temporarily when the engine is stopped, prompt restart of the engine is achieved.

As described above, a memory having stored therein the first and second characteristics data maps (FIGS. 4 and 5) can be provided. When the speed (N) of the engine 9 is not greater than the certain complete explosion rotational speed (N2) (FIG. 2), the choke valve 42 is controlled based on the first characteristics data map (FIG. 4), whereas when the speed (N) of the engine 9 is the complete explosion rotational speed (N2) or greater (FIG. 3), the choke valve 42 is controlled based on the second characteristics data map (FIG. 5).

As a result, those two types of data maps can be selectively used in response to the speeds (N) of the engine 9 before and after the engine speed has become the complete explosion rotational speed (N2). Accordingly, more reliable start of the engine 9 can be achieved, and the engine can shift smoothly from the beginning to the end of the starting operation and to the normal operation.

As described above, the first characteristics data map (FIG. 4) is designed such that the valve opening speed (V) of the choke valve 42 becomes higher for the higher temperature (T) of the engine 9.

The engine 9 is easier to start at higher temperatures (T). For this reason, the first characteristics data map is designed such that the valve opening speed (V) of the choke valve 42 becomes higher for the higher temperature (T) of the engine 9, as described above. As a result, the engine 9 can be started smoothly and promptly.

As described above, the second characteristics data map (FIG. 5) is designed such that when the opening (O) of the choke valve 42 has become the predetermined midway opening (O4), the choke valve is held at the predetermined midway opening (O4) for the predetermined time (t) and that after the lapse of the predetermined time (t), the choke valve 42 is moved at the certain valve opening speed (V) until it achieves the full opening (S23).

As a result, the start state and the output state of the engine 9 can be balanced correspondingly to the choke valve 42 being temporarily held at the predetermined midway opening (O4) for the predetermined time (t) in the middle of the valve opening motion as described above. Accordingly, even when the engine 9 undergoes some kind of load during the start, it can react against the load, so that the engine 9 becomes less likely to stall. Thus, the proper start of the engine 9 is achieved more reliably.

As described above, the second characteristics data map is also designed such that the above predetermined time becomes shorter for the higher temperature (T) of the engine 9.

The engine 9 is easier to start at higher temperatures (T). For this reason, the second characteristics data map is designed such that the predetermined time (t) for which the choke valve 42 is held at the predetermined midway opening (O4) becomes shorter for the higher temperature (T) of the engine 9, as described above. As a result, the engine 9 can be started more smoothly and more promptly.

As described above, the second characteristics data map is also designed such that of the first valve opening motion of the choke valve 42 to be continued until it achieves the predetermined midway opening (O4) and the second valve opening motion of the choke valve 42 to be continued until it achieves the full opening from the predetermined midway opening (O4), the valve opening speed (V) at least during the second valve opening motion becomes higher for the higher temperature (T) of the engine 9.

The engine 9 is easier to start at higher temperatures (T). For this reason, the second characteristics data map is designed such that the valve opening speed (V) at which the choke valve 42 is moved until it achieves the full opening becomes higher for the higher temperature (T) of the engine 9, as described above. As a result, the engine 9 can be started more smoothly and more promptly.

With the above configuration, after the speed (N) of the engine 9 had become the complete explosion rotational speed (N2) or greater (S13), when the speed (N) of the engine 9 has become a value not greater than the complete explosion rotational speed (N2) while the choke valve 42 is moving from the predetermined midway opening (O4) toward the full opening, the choke valve 42 is held at an after-complete explosion midway opening (O5, which is not shown) at that time point. Thereafter, when the speed (N) of the engine 9 has become the complete explosion rotational speed (N2) or greater, the choke valve 42 is moved from the after-complete explosion midway opening (O5) toward the full opening.

In other words, during the start of the engine 9, even if the speed (N) of the engine has temporarily decreased to a value not greater than the complete explosion rotational speed (N2) due to some kind of load or the like, the opening (O) of the choke valve 42 is held at the after-complete explosion midway opening (O5) at that time point for the temporary stop of the valve opening motion. Thereafter, when the engine speed has become the complete explosion rotational speed (N2) or greater, the choke valve 42 is moved from the after-complete explosion midway opening (O5) toward the full opening.

Thus, once the speed (N) of the engine 9 has become a value not greater than the complete explosion rotational speed (N2), the valve opening motion of the choke valve 42 is stopped temporarily until the engine speed returns to the complete explosion rotational speed (N2) or greater. While the valve opening motion of the choke valve is stopped, a rich mixture 13 is supplied to the engine 9 compared to the case where such motion is continued. Accordingly, even if the speed (N) of the engine has decreased temporarily as described above, the engine 9 is less likely to stall. As a result, the proper start of the engine 9 is achieved more reliably.

With the above configuration, in the middle of at least the second valve opening motion of the first valve opening motion and the second valve opening motion of the choke valve 42, when the temperature (T) of the engine 9 has changed, the second characteristics data map is used in response to the temperature (T) of the engine 9 at that time point (S17) to control the choke valve 42 (S18). It is understood that the choke valve 42 can be controlled in the middle of only the second valve opening motion of the first and second valve opening motions, in the same manner as described above.

As a result, the choke valve 42 is controlled based on the optimal characteristics corresponding to the most recent temperature (T) of the engine until it achieves the full opening. Thus, the engine 9 can be started more smoothly and more promptly.

It should be understood that the foregoing description is merely based on the illustrated example, and the engine 9 can be those incorporated in other machines such as vehicles. It should also be understood that S8, S14 and S15 as well as S10, S11 and S19 to S21 in the program for the controller 69 may be omitted.

Although these inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been shown and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above.

What is claimed is:

1. An auto choke device for an engine, the auto choke device comprising:

a starter motor configured to start the engine; a choke valve configured to vary an opening of an intake passage of the engine;

an actuator arranged to move the choke valve to vary the opening of the intake passage; and a controller programmed to control the actuator to move the choke valve to fully closed position regardless of the temperature of the engine such that the choke valve is always in the fully closed position when the starter motor is first activated, to then start opening the choke valve from the fully closed position upon the activation of the starter motor, and to then continue to open the choke valve at a desired valve opening speed until the choke valve achieves a predetermined start opening position based at least on the temperature of the engine; wherein the controller is programmed to control the actuator to hold the choke valve at a midway opening position during its opening motion when an engine speed is below a desired start rotational speed, and to control the actuator to move the choke valve from the midway opening position toward the predetermined start opening position when the engine speed has reached or surpassed the desired start rotational speed.

2. The auto choke device of claim 1, further comprising:

a memory having stored therein first and second characteristics data maps based at least on the temperature of the engine, the first and second characteristics data maps being different from each other, wherein the controller is programmed to control the actuator and the choke valve based on the first characteristics data map when the engine speed is lower than a desired complete explosion rotational speed, and based on the second characteristics data map when the engine speed is greater than or equal to the desired complete explosion rotational speed.

3. The auto choke device of claim 2, wherein the first characteristics data map controls the actuator such that the valve opening speed of the choke valve increases as the engine temperature increases.

4. The auto choke device of claim 2, wherein the second characteristics data map controls the actuator such that when the choke valve reaches a predetermined midway opening position, the choke valve is held at the predetermined midway opening position for a predetermined period of time, and the choke valve is moved at the desired valve opening speed until the choke valve achieves a fully open position after the lapse of the predetermined period of time.

5. The auto choke device of claim 4, wherein the predetermined period of time becomes shorter as the temperature of the engine increases.

6. The auto choke device of claim 4, wherein the second characteristics data map controls the actuator such that the choke valve achieves the predetermined midway opening position during a first valve opening motion, and the choke valve achieves the fully open position from the predetermined midway opening position during a second valve opening motion, the valve opening speed during at least the second valve opening motion increasing as the engine temperature increases.

7. The auto choke device of claim 4, wherein the second characteristics data map controls the actuator such that the choke valve is held at an after-complete explosion midway opening position while moving from the predetermined midway opening position toward the fully opening position when the engine speed is below the complete explosion rotational speed, the choke valve is moved from the after-complete explosion midway opening position toward the fully open position when the engine speed becomes equal to or greater than the complete explosion rotational speed.

8. The auto choke device of claim 6, wherein the second characteristics data map controls the choke valve operation in response to a change in the engine temperature during at least one of the first and second valve opening motions of the choke valve.

* * * * *